US011328863B2

(12) United States Patent
Calamari et al.

(10) Patent No.: US 11,328,863 B2
(45) Date of Patent: May 10, 2022

(54) COMBINED INSTRUMENT TRANSFORMER FOR HV APPLICATIONS

(71) Applicant: HITACHI ENERGY SWITZERLAND AG, Baden (CH)

(72) Inventors: Matteo Calamari, Vigolzone (IT); Alessandro Motta, Pavia (IT); Ennio Errico, Casirate d'Adda (IT)

(73) Assignee: HITACHI ENERGY SWITZERLAND AG, Baden (SE)

( * ) Notice: Subject to any disclaimer, the term of this patent is extended or adjusted under 35 U.S.C. 154(b) by 330 days.

(21) Appl. No.: 16/472,446

(22) PCT Filed: Dec. 21, 2016

(86) PCT No.: PCT/EP2016/082189
§ 371 (c)(1),
(2) Date: Jun. 21, 2019

(87) PCT Pub. No.: WO2018/113954
PCT Pub. Date: Jun. 28, 2018

(65) Prior Publication Data

US 2020/0388437 A1 Dec. 10, 2020

(51) Int. Cl.
*H01F 38/36* (2006.01)
*H01F 27/06* (2006.01)
(Continued)

(52) U.S. Cl.
CPC ..... *H01F 38/36* (2013.01); *H01F 27/02* (2013.01); *H01F 27/06* (2013.01); *H01F 27/26* (2013.01)

(58) Field of Classification Search
CPC ..... H01F 27/00–42; H01F 38/00–36
See application file for complete search history.

(56) References Cited

U.S. PATENT DOCUMENTS 4,471,333 A * 9/1984 Stephanides ..... G01R 15/183 336/84 C
4,731,599 A * 3/1988 Preissinger ..... H01F 38/36 336/107
(Continued)

FOREIGN PATENT DOCUMENTS

CN 87101790 A 9/1987
CN 2244246 Y 1/1997
(Continued)

OTHER PUBLICATIONS

European Patent Office, International Search Report & Written Opinion issued in corresponding Application No. PCT/EP2016/082189, dated Aug. 10, 2017, 13 pp.
(Continued)

*Primary Examiner* — Tuyen T Nguyen
(74) *Attorney, Agent, or Firm* — Sage Patent Group

(57) ABSTRACT

A combined instrument transformer for HV applications which includes a current instrument transformer CT, having a current transformer core and a current transformer primary duct fitted into the current transformer core, and a voltage instrument transformer VT, having a voltage transformer core and voltage transformer windings fitted around at least a portion of the voltage transformer core. The current instrument transformer and the voltage instrument transformer are housed in a common internal volume of a single enclosure, the internal volume being delimited by a lateral wall, a base disk insulator and a substantially planar cover.

20 Claims, 3 Drawing Sheets

(51) Int. Cl.
*H01F 27/02* (2006.01)
*H01F 27/26* (2006.01)

(56) References Cited

U.S. PATENT DOCUMENTS 4,845,453 A * 7/1989 Preissinger ..... H01F 38/26
336/84 C
8,749,226 B2 * 6/2014 Patel ..... H01F 27/06
324/126

FOREIGN PATENT DOCUMENTS

| | | | |
|---|---|---|---|
| CN | 201918255 | U | 8/2011 |
| CN | 201936734 | U | 8/2011 |
| CN | 202384165 | U | 8/2012 |
| CN | 103208359 | A | 7/2013 |
| DE | 3908107 | A1 | 9/1990 |
| EP | 0236974 | A2 | 9/1987 |

OTHER PUBLICATIONS

Search Report, Chinese Patent Application No. 201680091738.0, dated Mar. 2, 2021, 4 pages.

* cited by examiner

COMBINED INSTRUMENT TRANSFORMER FOR HV APPLICATIONS

The present invention relates to a combined instrument transformer for high voltage (HV) applications. In particular, the present invention relates to combined instrument transformer for high voltage applications having a greatly simplified structure with respect to the existing instrument transformer. For the purposes of the present invention the term "combined instrument transformer" designates a measurement instrument for high voltage (HV) applications combining a Current Transformer module and a Voltage (or Potential) Transformer module in one and the same instrument unit. Also, for the purposes of the present invention, the term high voltage (HV) is referred to applications above 1 kV.

Instrument transformers—which include Voltage (Potential) Transformers VT (normally of inductive or capacitive type), Current Transformers CT and Combined Instrument Transformers CIT—are well-known types of equipment in high voltage applications, and are typically used for, e.g., metering, monitoring, protection and control of the high voltage system.

In particular, the combined instrument transformers are measurement instruments which combine in one and the same instrument unit a voltage transformer and a current transformer. In this way—since the current transformer and the voltage transformer are accommodated in a single unit—it is possible to optimize the use of the space in the substation and achieve some cost savings with respect to conventional solutions with two separated measurement units. Thus, the combined instrument transformers are normally used in the electrical power industry when the space in the substation is limited.

Typically, the combined instrument transformers of the known type comprise a dedicated enclosure for each instrument, with one insulating support being sometimes used in between them. Thus, in the latter case, the typical design of the combined instrument transformer comprises a basement housing one of the instrument transformer, an insulating support vertically protruding from the basement and supporting a dedicated enclosure for the other instrument transformer. Depending on the applications, dielectric systems such as oil or SF6 or other gases with dielectric properties, are normally used.

In addition to the space savings, the combined instrument transformer design—with the current transformer and the voltage transformer modules in the same measurement unit—gives additional considerable cost savings, since the number of supporting structures and connections is lower, and since the transportation and installation costs are also lower.

However, the resulting structure can be bulky since incorporates two enclosures (each housing the CT or the VT) with possibly an intermediate insulator in between said enclosures. Moreover, each enclosure must be provided with one or more sealing to separate one enclosure form the other and/or from the intermediate insulator, with consequent increase of equipment costs as well as increase of manufacturing time and costs.

Hence, the present disclosure is aimed at providing a combined instrument transformer for HV applications which allows overcoming at least some of the above mentioned shortcomings.

In particular, the present disclosure is aimed at providing a combined instrument transformer for HV applications in which the overall dimensions are reduced with respect to the existing solutions.

Moreover, the present disclosure is aimed at providing a combined instrument transformer for HV applications in which the sealing, and in general the number of components, can be reduced thereby reducing the equipment costs and simplifying the assembly process.

Thus, the present invention relates to a combined instrument transformer for HV applications, which is characterized in that it comprises a current instrument transformer CT, having a current transformer core and a current transformer primary duct fitted into said current transformer core, and a voltage instrument transformer VT, having a voltage transformer core and voltage transformer windings fitted around at least a portion of said voltage transformer core, said current instrument transformer and said voltage instrument transformer being housed in a common internal volume of a single enclosure, said internal volume being delimited by a lateral wall, a support device, preferably a base disk insulator, and a top cover, preferably a substantially planar cover.

In practice as better explained in the following description, one of the distinctive feature of the combined instrument transformer for HV applications of the present invention is the use of a single enclosure for both the current transformer and the voltage transformer, differently from the existing solutions, in which two dedicated enclosures are used, with one insulating support sometimes being positioned in between.

This characteristic allows reducing the overall dimensions of the equipment, since the single enclosure is much less bulky than the two enclosures normally used in the combined instrument transformer of know type for separately housing the current transformer and the voltage transformer.

Moreover, the use of a single enclosure allows removing at least one sealing (and up to three, if the said insulating support is considered). It also leads to a general reduction of the number of components, thereby greatly simplifying the assembly process.

In general, said enclosure housing the current transformer and the voltage transformer typically can comprise first and second primary terminals for connection to a HV line and electrically connected to said current transformer primary duct.

Preferably, in the combined instrument transformer for HV applications according to the present invention, the enclosure housing the current transformer and the voltage transformer is vertically mounted on a hollow core insulator—or a ceramic insulator in case of oil insulation—and a basement.

In such a case—according to a preferred embodiment of the combined instrument transformer for HV applications of the present invention—said support device, which is preferably a base disk insulator, can separate said internal volume from said hollow core insulator or said ceramic insulator.

Preferably, said voltage instrument transformer VT comprise VT secondary wires connected to said voltage transformer windings and said current instrument transformer CT comprises CT secondary wires connected to said current transformer core.

In a particular embodiment of the combined instrument transformer for HV applications according to the present invention, said current transformer core is shielded into a metallic plate shell.

In such a case, said VT secondary wires can be conveniently fitted into another metallic plate shell.

According to a preferred embodiment of the combined instrument transformer for HV applications of the present invention, said current transformer core is preferably supported from below by said base disk insulator.

According to a further preferred embodiment of the combined instrument transformer for HV applications of the present invention, said voltage transformer core is preferably supported from the above by said substantially planar cover.

Similarly, also said voltage transformer windings can be preferably supported from the above by said substantially planar cover.

In a particular embodiment of the combined instrument transformer for HV applications according to the present invention, said hollow core insulator or said ceramic insulator comprises a secondary duct running inside said hollow core insulator or said ceramic insulator from said base disk insulator to said basement, said VT secondary wires and said CT secondary wires running inside said secondary duct.

Further features and advantages of the present invention will be more clear from the description of preferred but not exclusive embodiments of a combined instrument transformer for HV applications according to the invention, shown by way of examples in the accompanying drawings, wherein.

Figure 1:
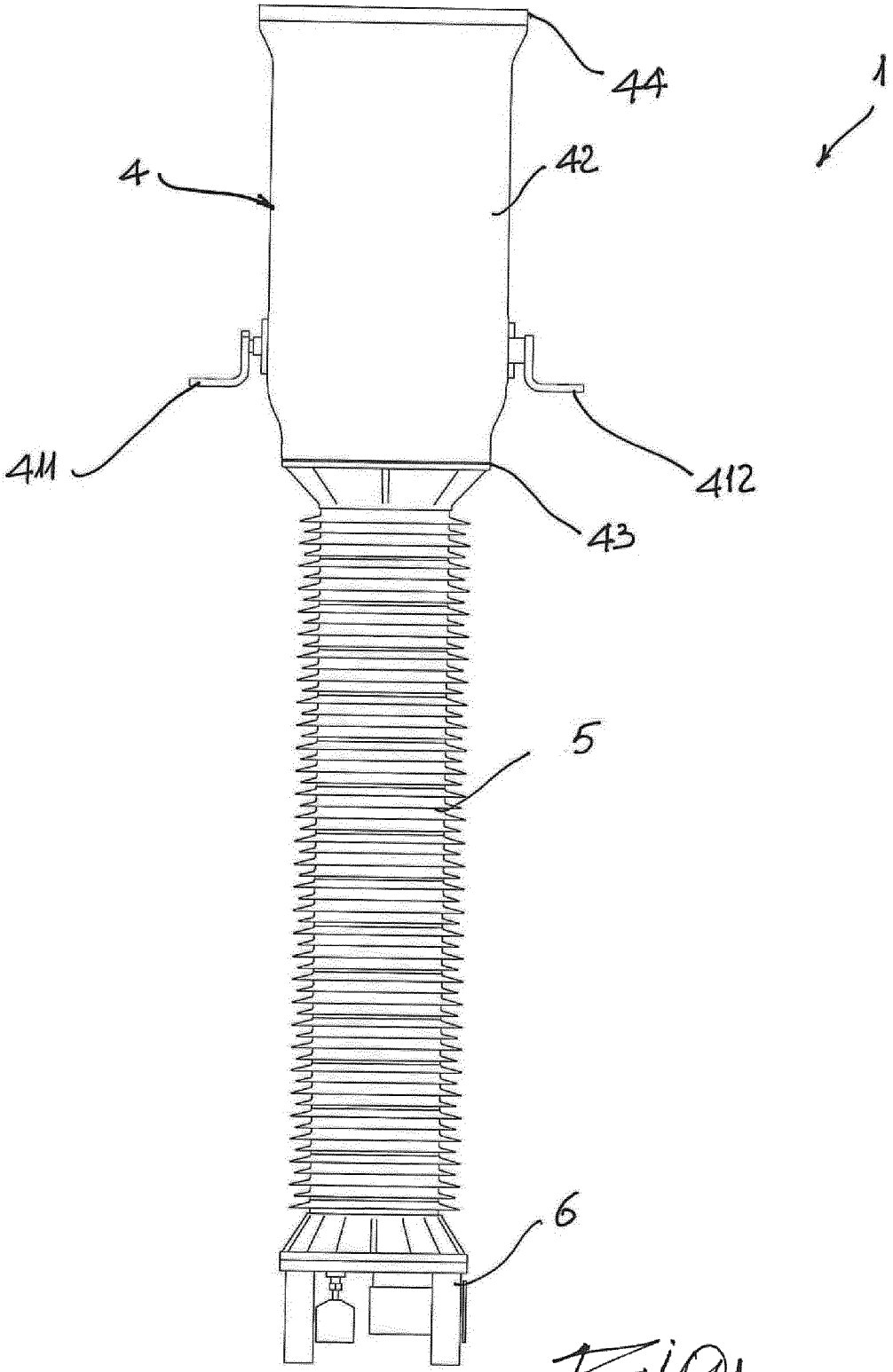
FIG. 1 is a front view of an embodiment of a combined instrument transformer for HV applications according to the present invention.

With reference to the attached figures, a combined instrument transformer for HV applications according to the present invention—designated with the reference numeral 1—in its more general definition comprises a current instrument transformer CT 2 and a voltage instrument transformer VT 3.

The current instrument transformer CT 2 typically comprises a current transformer core 21 and a current transformer primary duct 22 which is fitted into said current transformer core 21.

Similarly, the a voltage instrument transformer VT 3 typically comprises a voltage transformer core 31 and voltage transformer windings 32 which are fitted around at least a portion of said voltage transformer core 31

One of the characterizing features of the combined instrument transformer 1 for HV applications of the present invention is given by the fact that said current instrument transformer CT 2 and said voltage instrument transformer VT 3 are conveniently housed in a common internal volume 41 of a single enclosure 4.

As shown in the attached figures, said common internal volume 41 is delimited by a lateral wall 42, a base disk insulator 43 and a substantially planar cover 44.

Thus it is clear from the attached figures that the overall space of the single enclosure 4 is much less than the space and volume normally occupied by the two enclosures normally needed in the combined instrument transformer of know type for separately housing the current instrument transformer CT and the voltage instrument transformer VT.

It is also clear that in the combined instrument transformer 1 of the present invention, the number of sealing is greatly reduced with respect to the conventional instrument transformers, only one disk insulator 43 being for instance present in the embodiment shown in the attached figures.

The combined instrument transformer 1 for HV applications of the present invention can be vertically mounted on a hollow core insulator 5 and a basement 6 as shown in the attached figures.

In particular, FIG. 1 shows an overview of an embodiment of the combined instrument transformer 1 according to the present invention. According to such embodiment, the combined instrument transformer 1 is based on top core design, meaning that the magnetic cores of the current instrument transformer CT 2 and voltage instrument transformer VT 3 are located at the top, where they are fit into the single enclosure 4, and are connected to the HV line through the first 411 and second 412 primary terminals.

The top portion is supported by a hollow core insulator 5. The basement 6 at the bottom of the equipment provides fixation points for a support structure, as well as connection of instrumentation and outlet and terminals for secondary cables.

As previously said, in the embodiment of the combined instrument transformer for HV applications shown ion the attached figures, only one insulator 43 is needed, said insulator 43 being positioned at the base of the enclosure 4 and separating the internal volume 41 of the enclosure 4 from said hollow core insulator 5.

In the combined instrument transformer 1 of the present invention, the voltage instrument transformer VT 3 conveniently comprise VT secondary wires 35 which are connected to said voltage transformer windings 32.

Also, the current instrument transformer CT 2 conveniently comprises CT secondary wires 25 which are connected to said current transformer core 21.

Preferably, as shown in the attached figures, said current transformer core 21 is shielded into a metallic plate shell 28 and is supported from below by said base disk insulator 43. In such a case, also said VT secondary wires 35 can be conveniently fitted into said metallic plate shell 28.

Figure 2:
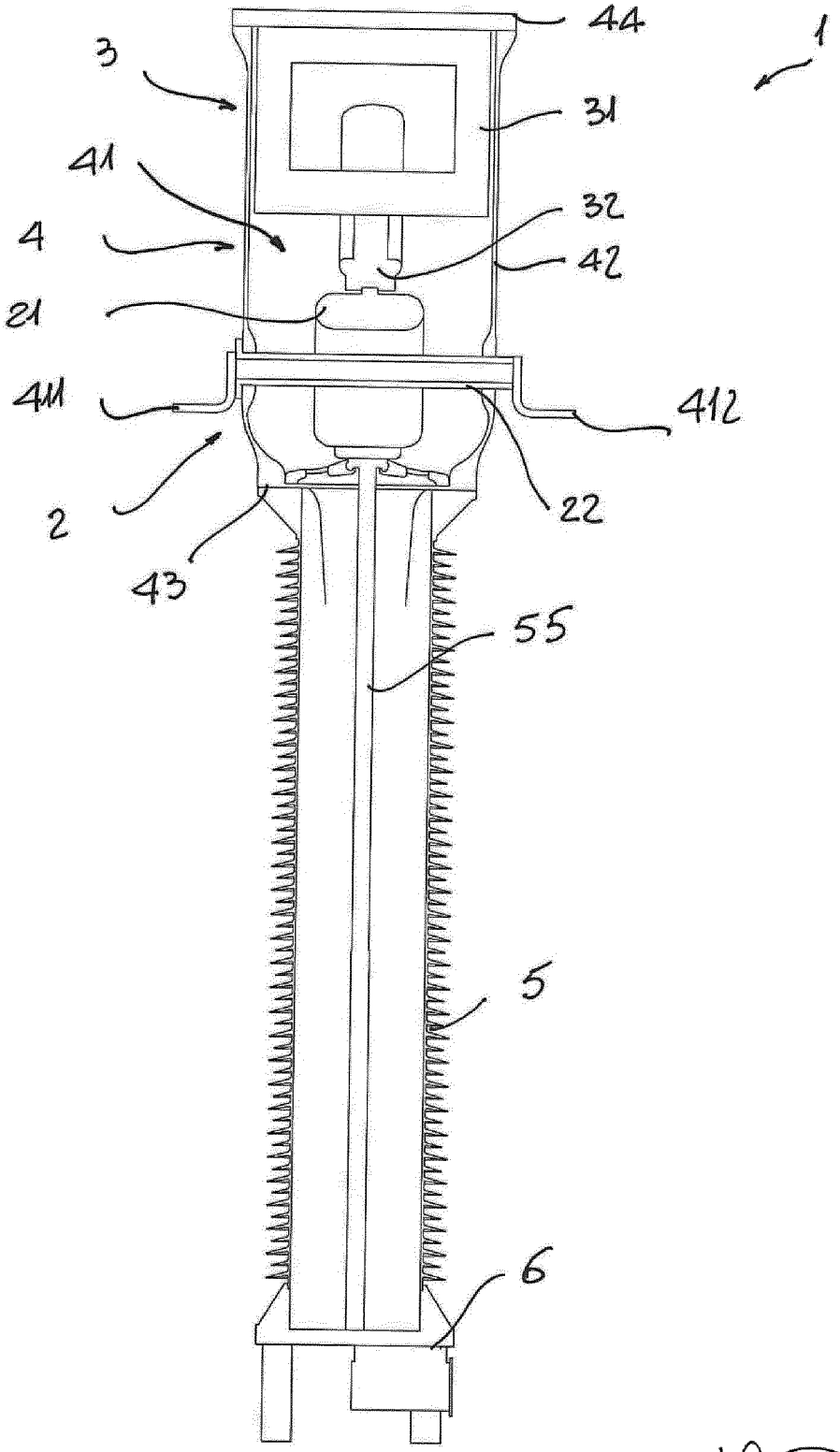
FIG. 2 is a section view of an embodiment of a combined instrument transformer for HV applications according to the present invention.
Figure 3:
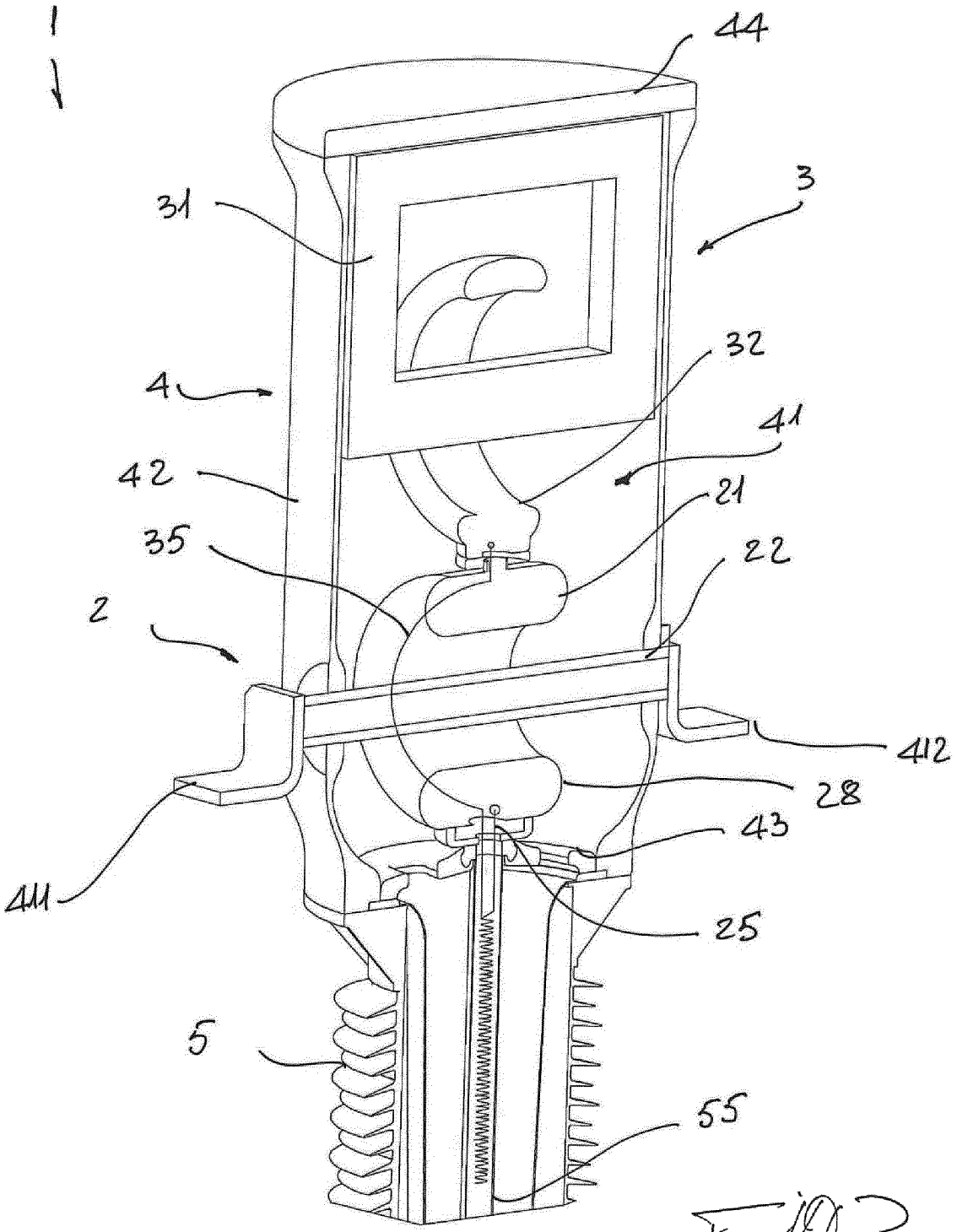
FIG. 3 is a perspective view in section of an embodiment of a combined instrument transformer for HV applications according to the present invention.

Also, in the embodiment of the combined instrument transformer 1 for HV applications shown in FIGS. 2 and 3, said voltage transformer core 31 is supported form the above by said substantially planar cover 44.

Similarly, also the voltage transformer windings 32 can be conveniently supported form the above by the substantially planar cover 44.

According to a preferred embodiment of the combined instrument transformer 1 for HV applications, the hollow core insulator 5 comprises a secondary duct 55 running inside said hollow core insulator 5 from said base disk insulator 43 to said basement 6, said VT secondary wires 35 and said CT secondary wires 25 running inside said secondary duct 55.

In practice, with reference to FIG. 2, the voltage transformer core 31 and the voltage transformer windings 32 are positioned into the said single enclosure 4, together with the current instrument transformer CT 2.

The current transformer primary duct 22 is connected to the enclosure 4 and the first 411 and second 412 primary terminals and is fitted into the current transformer core 21, with one or more turns. The VT secondary wires 35 and the CT secondary wires 25 are fitted together into the secondary duct 55, running through the hollow core insulator 5, down to the basement 6.

With reference also to FIG. 3, the voltage transformer core 31 and the voltage transformer windings 32 are supported from the above by the substantially planar cover 44 which is mounted on the top of the single enclosure 4, while the current transformer core 21 is supported from below by said base disk insulator 43 which separates the internal volume 41 of the enclosure 4 from said hollow core insulator 5.

The current transformer core 21 is shielded into a metallic plate shell 28. The VT secondary wires 35 of the voltage instrument transformer, which are connected to the voltage transformer windings 32, are also fitted into the said Current Transformer metallic plate shell 28, in order to reach the secondary duct 55, passing through the base disk insulator 43 together with the CT secondary wires 25 of the Current Transformer.

From the above-description it is clear that the combined instrument transformer 1 for HV applications of the present invention fully achieved the intended aim and purposes, solving the prior art problems.

In particular, thanks to the use of a single enclosure housing both the current instrument transformer and the voltage instrument transformer CT, the overall dimensions of the equipment are reduced.

Moreover, the number of components, in particular the number of expensive sealing is greatly reduced with respect to the conventional instrument transformers, only one disk insulator being for instance present in the embodiment shown in the attached figures.

It is also worth noting that the unconventional design of the combined instrument transformer of the present invention, in which the voltage transformer core 31 and the voltage transformer windings 32 are supported from the above by the substantially planar cover 44, while the while the current transformer core 21 is supported from below by the base disk insulator 43 allows reducing the number of components, and thereby the costs of the combined instrument transformer.

In practice, in the combined instrument transformer some of the components can have a double function, e.g.: the substantially planar cover 44 closes the internal space 41 of the enclosure 4 from the top and at the same time supports from the above the voltage transformer core 31 and the voltage transformer windings 32; similarly, the base disk insulator 43 separates the internal space 41 of the enclosure 4 from the hollow insulator 5 and at the same time support the current transformer core 21 from below.

Several variations can be made to the combined instrument transformer for HV applications thus conceived, all falling within the scope of the attached claims. In practice, the materials used and the contingent dimensions and shapes can be any, according to requirements and to the state of the art.

The invention claimed is:

1. A combined instrument transformer for HV applications, comprises:

a current instrument transformer CT, having a current transformer core and a current transformer primary duct fitted into said current transformer core; and a voltage instrument transformer VT, having a voltage transformer core and voltage transformer windings fitted around at least a portion of said voltage transformer core, wherein the current instrument transformer CT and the voltage instrument transformer VT are housed in a common internal volume of a single enclosure, and wherein the common internal volume is delimited by a lateral wall, a support device and a planar cover.

2. The combined instrument transformer for HV applications according to claim 1, wherein the enclosure is vertically mounted on a hollow core insulator or a ceramic insulator and a basement and in that the support device is a base disk insulator.

3. The combined instrument transformer for HV applications according to claim 1, wherein the enclosure comprises first and second primary terminals for connection to a HV line and electrically connected to the current transformer primary duct and in that the support device is a base disk insulator.

4. The combined instrument transformer for HV applications according to claim 2, wherein the base disk insulator separates said internal volume from the hollow core insulator or ceramic insulator.

5. The combined instrument transformer for HV applications according to claim 1, wherein the voltage instrument transformer VT comprises VT secondary wires connected to the voltage transformer windings, and wherein the current instrument transformer CT comprises CT secondary wires connected to the current transformer core.

6. The combined instrument transformer for HV applications according to claim 1, wherein the current transformer core is shielded into a metallic plate shell.

7. The combined instrument transformer for HV applications according to claim 1, wherein the current transformer core is in contact with and supported from below by the base disk insulator.

8. The combined instrument transformer for HV applications according to claim 1, wherein the planar cover is in contact with and arranged above the voltage transformer core.

9. The combined instrument transformer for HV applications according to claim 1, wherein the planar cover is in contact with and arranged above the voltage transformer windings.

10. The combined instrument transformer for HV applications according to claim 1, wherein the hollow core insulator or ceramic insulator comprises a secondary duct running inside the hollow core insulator or ceramic insulator from the base disk insulator to the basement, the VT secondary wires and the CT secondary wires running inside the secondary duct.

11. The combined instrument transformer for HV applications according to claim 5, wherein the VT secondary wires are fitted into a metallic plate shell.

12. The combined instrument transformer for HV applications according to claim 2, wherein the enclosure comprises first and second primary terminals for connection to a HV line and electrically connected to the current transformer primary duct and in that the support device is a base disk insulator.

13. The combined instrument transformer for HV applications according to claim 3, wherein the base disk insulator separates the internal volume from the hollow core insulator or ceramic insulator.

14. The combined instrument transformer for HV applications according to claim 12, wherein the base disk insulator separates the internal volume from said hollow core insulator or ceramic insulator.

15. The combined instrument transformer for HV applications according to claim 2, wherein the current transformer core is shielded into a metallic plate shell.

16. The combined instrument transformer for HV applications according to claim 3, wherein the current transformer core is in contact with and supported from below by the base disk insulator.

17. The combined instrument transformer for HV applications according to claim 2, wherein said the planar cover is in contact with and arranged to support the voltage transformer windings.

18. The combined instrument transformer for HV applications according to claim 2, wherein the hollow core insulator or ceramic insulator comprises a secondary duct running inside the hollow core insulator or ceramic insulator from the base disk insulator to the basement, wherein VT secondary wires and CT secondary wires run inside the secondary duct.

19. The combined instrument transformer for HV applications according to claim 6, wherein VT secondary wires are fitted into the metallic plate shell.

20. The combined instrument transformer for HV applications according to claim 1, wherein the planar cover is in contact with and arranged to support the voltage transformer windings are supported from the above by the planar cover;

wherein the enclosure is vertically mounted on a hollow core insulator or a ceramic insulator and a basement and in that the support device is a base disk insulator wherein the hollow core insulator or ceramic insulator comprises a secondary duct running inside the hollow core insulator or ceramic insulator from the base disk insulator to the basement, the VT secondary wires and the CT secondary wires running inside the secondary duct; and wherein the VT secondary wires are fitted into the metallic plate shell.

* * * * *